US006694680B2

(12) United States Patent
Zambelli et al.

(10) Patent No.: US 6,694,680 B2
(45) Date of Patent: Feb. 24, 2004

(54) LIFTING INSERT FOR PREFABRICATED CONCRETE COMPONENTS

(76) Inventors: Sergio Zambelli, Via Stezzano, 28, 24050 Zanica (IT); Benito Zambelli, Via Roma, 44, 24050 Zanica (IT)

( * ) Notice: Subject to any disclaimer, the term of this patent is extended or adjusted under 35 U.S.C. 154(b) by 0 days.

(21) Appl. No.: 10/003,314

(22) Filed: Dec. 6, 2001

(65) Prior Publication Data

US 2002/0070322 A1 Jun. 13, 2002

(30) Foreign Application Priority Data

Dec. 11, 2000 (IT) ..... MI2000A2664

(51) Int. Cl.[7] ..... B66C 1/66; E04G 21/14

(52) U.S. Cl. ..... 52/125.2; 52/125.5; 52/704; 294/89

(58) Field of Search ..... 52/125.2, 125.4, 52/125.5, 704, 705, 706, 707; 294/89

(56) References Cited

U.S. PATENT DOCUMENTS

| | | | | | |
|---|---|---|---|---|---|
| 953,060 | A | * | 3/1910 | Ross | 52/298 |
| 3,181,276 | A | * | 5/1965 | Ballou | 52/701 |
| 3,236,019 | A | * | 2/1966 | Ballou | 52/705 |
| 3,420,014 | A | * | 1/1969 | Coutois et al. | 52/125.4 |
| 4,179,151 | A | * | 12/1979 | Tye | 294/89 |
| 5,829,207 | A | * | 11/1998 | Mackay Sim et al. | 52/125.4 |
| 5,899,043 | A | * | 5/1999 | Reay | 52/707 |
| 6,092,849 | A | * | 7/2000 | Zambelli et al. | 294/89 |
| 6,334,286 | B1 | * | 1/2002 | Zambelli et al. | 52/707 |

FOREIGN PATENT DOCUMENTS

| | | | | |
|---|---|---|---|---|
| DE | 21 42 066 | | 2/1973 | |
| DE | 197805 | * | 5/1978 | 52/125.5 |
| DE | 2938256 | * | 4/1981 | 52/125.5 |
| DE | 298 08 394 | | 8/1998 | |
| EP | 0 832 840 | | 4/1998 | |
| FR | 2 504 900 | | 11/1982 | |
| GB | 800 302 | | 8/1958 | |
| IT | 684253 | * | 3/1965 | 52/125.5 |

* cited by examiner

*Primary Examiner*—Carl D. Friedman
*Assistant Examiner*—Brian E. Glessner
(74) *Attorney, Agent, or Firm*—Guido Modiano; Albert Josif; Daniel O'Bryne

(57) ABSTRACT

A lifting insert for prefabricated concrete components with a bracket for increasing the shearing strength thereof. The insert is embeddable in the body of the component proximate to one of the faces of the component so that one of its ends protrudes, or is otherwise accessible, from the face of the component so that it is engageable by lifting means. The bracket of the insert comprises at least one brace, which is connected to the insert and is also embeddable in the body of the component. The brace is constituted by a lamina that wraps around the insert in a scarf-like fashion with one of its portions.

7 Claims, 2 Drawing Sheets

LIFTING INSERT FOR PREFABRICATED CONCRETE COMPONENTS

BACKGROUND OF THE INVENTION

The present invention relates to a lifting insert for prefabricated concrete components with a bracket for increasing the shearing strength thereof.

In the field of the production of prefabricated concrete components, it is known to embed in the body of the component, during its casting, metallic inserts to be used to lift the component.

In order to achieve adequate anchoring in the concrete casting, these inserts are provided with brackets.

Brackets are divided into two categories: those for increasing pulling strength and those for increasing shearing strength.

Brackets for increasing pulling strength are constituted, in most cases, simply by substantially U-shaped brackets made of steel rod inserted in one or more holes provided in the lifting insert. The function of these brackets is to provide an ideal extension of the insert in the concrete body, thus achieving higher resistance to extraction by affecting larger concrete regions located further away from the insert. In this manner, the forces applied to the insert are distributed over larger surfaces, which leads to a reduction in specific stresses.

The shearing stress that occurs when a transverse force is applied to the insert, for example when tipping prefabricated components of the panel type, is more critical to neutralize, since such stress, which is generally perpendicular to the larger faces of the component, affects a very small thickness of the component and it is therefore more difficult to adopt a bracket capable of distributing said stress effectively.

It should also be noted that tipping of the components is required in order to extract them from the formwork, i.e., when the component has not yet acquired its full mechanical strength. In these occasions it is quite likely for the tipping of the component to cause the breakage of the concrete due to the action of the insert on the contiguous regions.

Brackets for increasing shearing strength can in turn be divided into two categories: brackets composed of contoured braces made of steel rod, which extend transversely to the insert on planes perpendicular to the direction of the force that generates the shearing stress in order to affect regions of the concrete that lie laterally with respect to the insert, and brackets constituted by plates welded to the insert.

In the first case, provision of the bracket is entrusted fully to the experience and skill of the operator and it is therefore difficult to obtain a constant and precise result. A slight variation in the position of the rod that constitutes the brace with respect to the insert, or in the shape of the rod, is in fact sufficient to lead to a considerably different shearing strength.

In the second case, the random variability of the positioning and shaping of the brace is eliminated, but there are other drawbacks, such as for example the higher cost of the bracket, higher costs for galvanization of the insert, which must also affect the plate, and higher costs for storage and transport, since the insert and the plate cannot be separated.

Another drawback of this last bracket is the different strength obtained depending on whether the shearing stress acts in one direction or in the opposite direction.

Moreover, the welded plate generates a discontinuity in the body of the concrete component in a low-thickness region and accordingly can cause the separation of portions of concrete, reducing its overall strength.

SUMMARY OF THE INVENTION

The aim of the present invention is to solve the above mentioned problems, by providing a lifting insert for prefabricated concrete components with a bracket for increasing the shearing strength thereof, which can be arranged precisely with respect to the insert without necessarily having to weld it to the insert.

Within this aim, an object of the invention is to provide a lifting insert with a bracket that can be manufactured at a low cost.

Another object of the invention is to provide a lifting insert with a bracket that ensures substantially identical strength with shearing stresses acting in one direction or in the opposite direction.

Another object of the invention is to provide a lifting insert with a bracket that achieves high adhesion to the concrete, increasing the resistance of the insert against extraction from the concrete.

Another object of the invention is to provide a lifting insert with a bracket that can be increased simply and rapidly according to requirements.

This aim and these and other objects that will become better apparent hereinafter are achieved by a lifting insert for prefabricated concrete components with a bracket for increasing the shearing strength thereof, comprising an insert that can be embedded in the body of the component proximate to one of the faces of the component, said insert having an end that lies proximate to said face of the component and can be engaged by lifting means, at least one brace being provided which is connected to said insert and can be embedded with it in the body of the component, characterized in that said brace is constituted by a lamina that wraps around said insert in a scarf-like fashion with one of its portions.

BRIEF DESCRIPTION OF THE DRAWINGS

Further characteristics and advantages of the invention will become better apparent from the description of a preferred but not exclusive embodiment of the lifting insert with bracket for increasing the shearing strength thereof, according to the invention, illustrated only by way of non-limitative example in the accompanying drawings, wherein.

DESCRIPTION OF THE PREFERRED EMBODIMENTS

Figure 1:
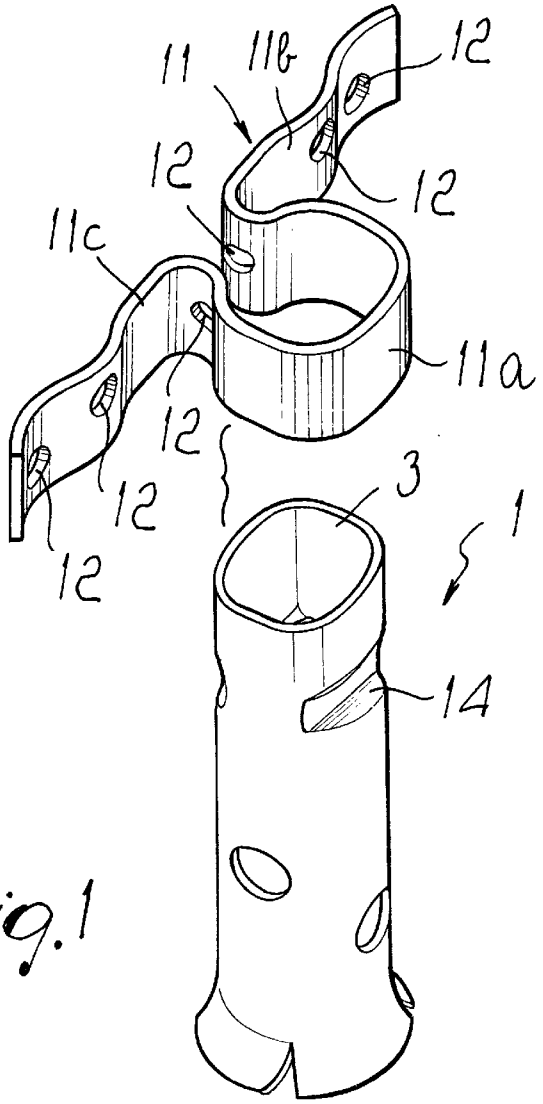
FIG. 1 is an exploded perspective view of the insert with the bracket according to the invention.

With reference to the figures, the insert 1 can be constituted by a lifting insert made of steel, of a known type, for example of the plate or nail type or having another configuration, which is designed to be embedded in the concrete body of a prefabricated component 2 proximate to one of its faces 2*a*, generally one of the smaller faces, i.e., one of the thickness faces of the component.

Depending on the type, the insert 1 can be embedded in the concrete so as to protrude with one of its ends from the body of the component 2 or can have, as in the case of an insert with a tubular body, an end 3 that is open flush with one face of the component, so as to be engaged by lifting means 4 of a known type.

According to the invention, the bracket 10 comprises at least one brace 11 constituted by a preferably metallic lamina that wraps around the insert 1 with a portion 11*a* in a scarf-like fashion.

Preferably, the brace 11 is constituted by a rolled flat strip of steel which has a rectangular cross-section and is substantially omega-shaped in order to surround almost completely, or at least over more than half of its extension, the perimeter of the insert 1.

The two wings 11*b*, 11*c* of the brace 11, which protrude on opposite sides from the central portion 11*a* that surrounds the insert 1, are conveniently undulated so as to affect concrete portions both parallel to the extension of said wings 11*b*, 11*c* and at right angles thereto, thus achieving higher resistance to extraction from the concrete.

Advantageously, the wings 11*b*, 11*c* are crossed by holes 12, through which the concrete can pass in order to achieve excellent embedding of the brace 11 in the concrete.

Figure 2:
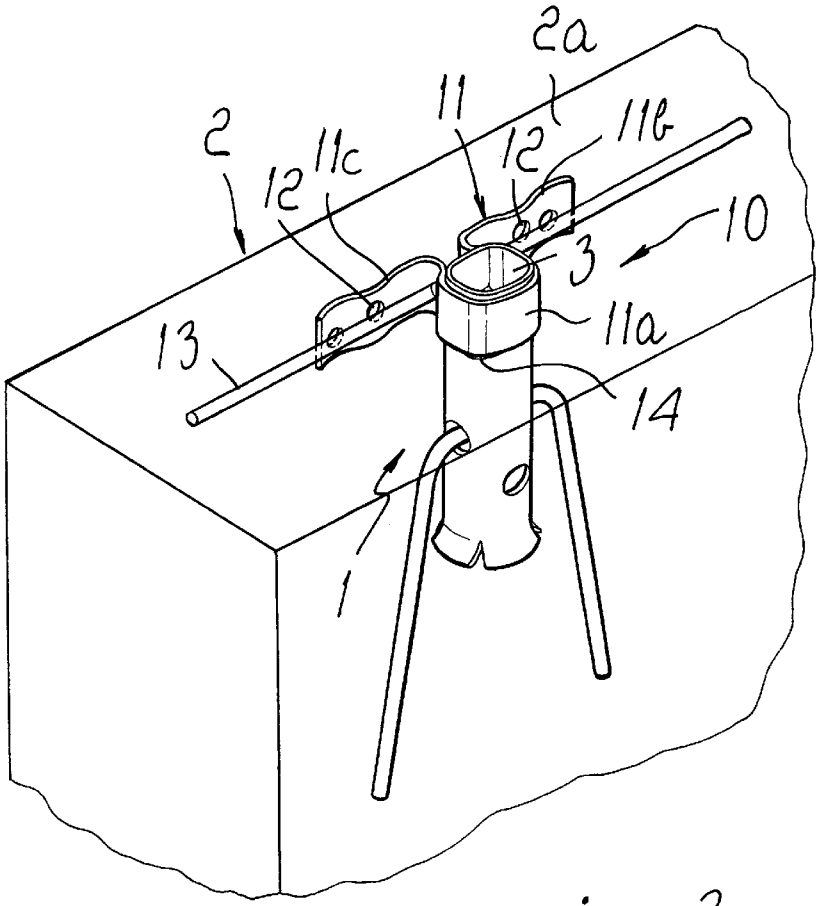
FIG. 2 is a view of the lifting insert with the bracket according to the invention, assembled and embedded in a prefabricated component made of concrete, shown in phantom lines for the sake of greater clarity.
Figure 3:
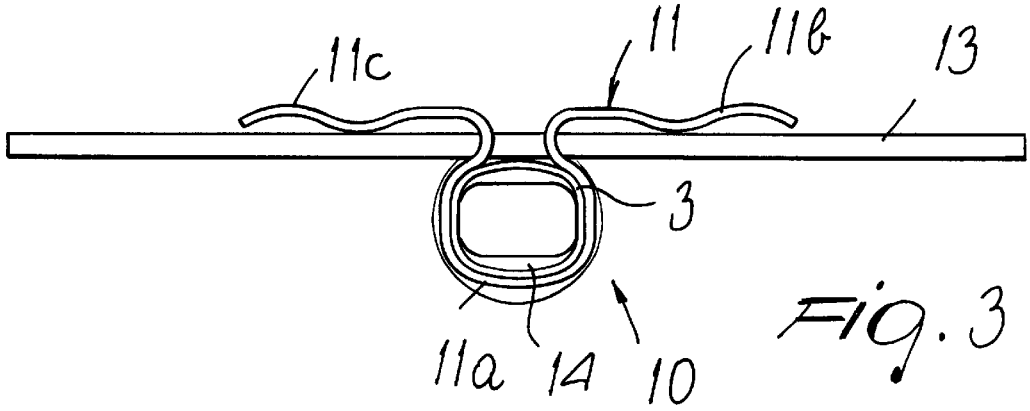
FIG. 3 is a view of the lifting insert with the bracket according to the invention, taken from a longitudinal end of the insert.
Figure 4:
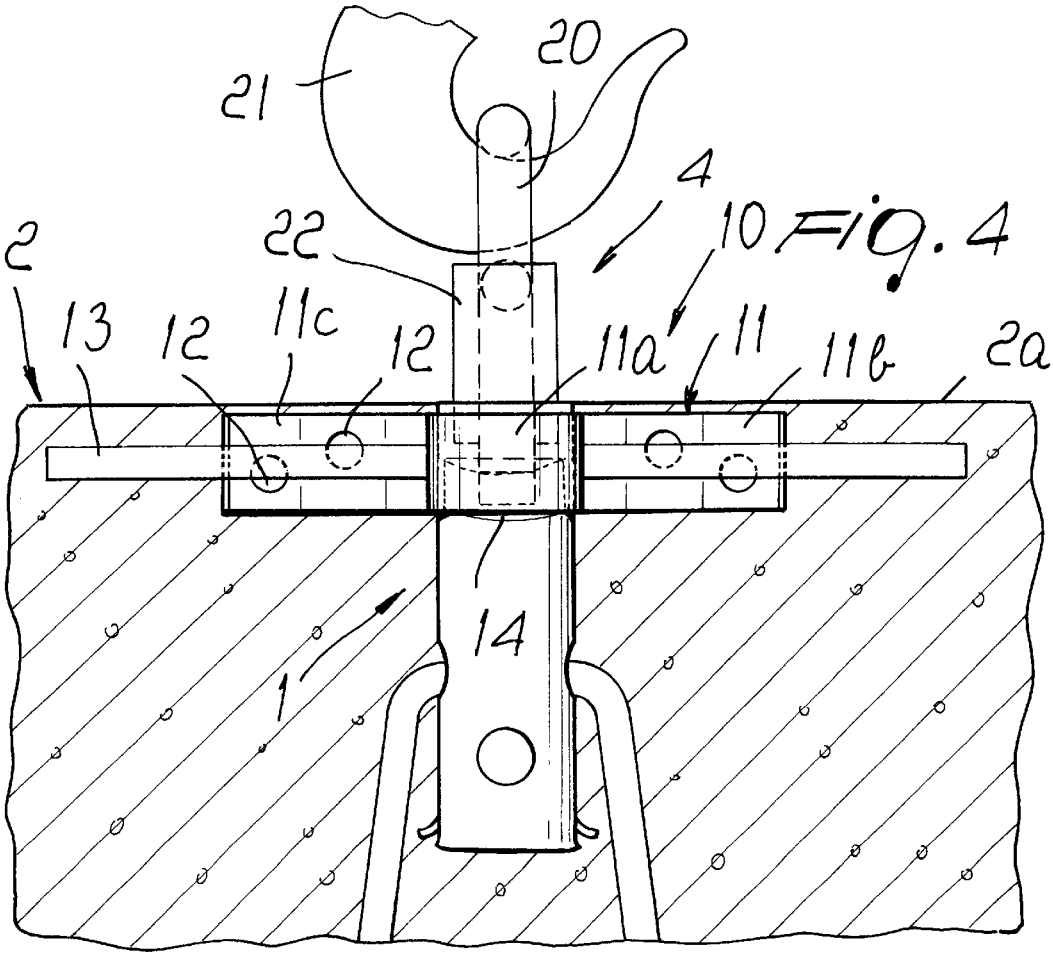
FIG. 4 is a side elevation view of the lifting insert with the bracket according to the invention, embedded in a prefabricated concrete component, with a component lifting device applied thereto.

Conveniently, at least two holes 12 arranged in the two wings 11*b*, 11*c*proximate to the central portion 11*a* are aligned one another so as to allow to augment its bracket 10 by inserting a bar 13, or steel rod, through such holes, as shown in particular in FIGS. 2 to 4.

Obviously, the other holes 12 also can be used to engage additional anchoring braces, constituted for example by steel rods, with the brace 11.

Although the brace according to the invention can be used with various kinds of lifting insert, it is preferably used with inserts having a tubular body, as shown in the figures, preferably of the type disclosed in EP-0 832 840 by the same Applicants.

As disclosed in such patent, to which reference is made for completeness of the description, an insert of this kind is designed to be embedded in the body of the concrete component 2 with an axial end 3 arranged flush with a lateral face of the component and open so as to allow the insertion of a handle-like element 20, to be used for lifting by means of a lifting hook 21, and optionally of a locking element 22.

In this case, the brace 11 is arranged around the tubular body of the insert 1 starting from its end 3 that is designed to be engaged in order to lift the component 2.

It should be noted that the end 3 of the component is flattened, and therefore the placement of the brace 11 around the insert 1 is even easier to perform and more stable because the brace 11 can be rested against the axial shoulder 14 formed by the flattening of the ends 3 of the insert 1.

In particular, the width of the brace 11 can be equal to the axial length of the flattened portion of the insert 1.

When used with an insert having a tubular body, as shown, the brace 11, by surrounding the end of the insert 1 that is designed to be engaged by the lifting means 4, increases the strength of the end 3, allowing to obtain an adequate strength even with a low thickness of the tubular body of the insert 1.

In practice it has been found that the lifting insert for prefabricated concrete components with a bracket for increasing the shearing strength thereof according to the invention fully achieves the intended aim and objects, since it ensures precise and repeatable positioning of the bracket without having necessarily to resort to its welding on the insert. For this reason, the lifting insert with the bracket according to the invention can be manufactured with costs that are comparable with those of lifting insert in which the bracket is provided by means of steel rods yet ensures a distinctly higher performance.

The lifting insert with bracket for increasing its shearing strength thus conceived is susceptible of numerous modifications and variations, all of which are within the scope of the appended claims; all the details may is further be replaced with other technically equivalent elements.

In practice, the materials used, so long as they are compatible with the specific use, as well as the dimensions, may be any according to requirements and to the state of the art.

The disclosures in Italian Patent Application No. MI2000A002664 from which this application claims priority are incorporated herein by reference.

What is claimed is:

1. In combination, a lifting insert for prefabricated concrete components and a bracket for increasing the shearing strength thereof, wherein the insert is embeddable in a body of a concrete component proximate to a face thereof, so that an end of the concrete component lies proximate to said face, whereby said end is engageable by a lifting means, and wherein the bracket comprises at least one brace which is connected to said insert and is embeddable, along with said insert in the body of the concrete component, said brace being constituted by a lamina that is shaped so as to wrap around said insert with a portion thereof, wherein said insert is constituted by a tubular body that has an end which is to be open at said face of the component, which is engageable by lifting means, said brace being wrapped, in a scarf-like fashion, around said end of the tubular body so that said brace only partially surrounds said tubular body, said end of the tubular body being flattened and being provided with an axial shoulder formed by the flattening of the end, said brace of the bracket resting upon said shoulder to increase shearing strength of the insert.

2. The combination of claim 1, wherein said bracket is substantially omega-shaped, in order to surround said insert at least partially.

3. The combination of claim 2, wherein said brace surrounds at least partially said insert proximate to said end thereof that is engageable by way of lifting means.

4. The combination of claim 2, wherein said omega-shaped bracket comprises wings which are undulated.

5. The combination of claim 4, wherein said brace has perforations provided along an extension thereof.

6. The combination of claim 5, further comprising a reinforcement bar, said perforations comprising at least two holes formed at an initial region of said wings, said at least two holes being aligned one another and accommodating said reinforcement bar.

7. The combination of claim 1, wherein said insert and said brace are made of steel.

* * * * *